US006486421B1

(12) United States Patent
Jones et al.

(10) Patent No.: US 6,486,421 B1
(45) Date of Patent: Nov. 26, 2002

(54) MECHANICAL INTERLOCK WITH OVERTRAVEL COMPENSATION FOR COORDINATING OPERATION OF CIRCUIT BREAKERS

(75) Inventors: William J. Jones, Cranberry Township, PA (US); James J. Benke, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/559,089

(22) Filed: Apr. 27, 2000

(51) Int. Cl.[7] ..... H01H 9/20
(52) U.S. Cl. ..... 200/50.32; 200/50
(58) Field of Search ..... 200/50.32, 50.33, 200/50.35, 50.37, 50.4, 308

(56) References Cited

U.S. PATENT DOCUMENTS

| | | | | | |
|---|---|---|---|---|---|
| 2,904,649 | A | * | 9/1959 | Ranson | 200/50.33 |
| 3,213,223 | A | * | 10/1965 | Sickler | 200/50.32 |
| 3,303,300 | A | * | 2/1967 | Turnbull | 200/50.33 |
| 3,778,633 | A | * | 12/1973 | DeVisser et al. | 307/64 |
| 4,286,242 | A | | 8/1981 | Mrenna et al. | |
| 4,760,278 | A | * | 7/1988 | Thomson | 307/64 |
| 5,023,469 | A | | 6/1991 | Bassett et al. | |
| 5,436,415 | A | | 7/1995 | Smith et al. | |
| 5,581,133 | A | | 12/1996 | Smith et al. | |
| 5,914,467 | A | | 6/1999 | Jonas et al. | |
| 5,929,405 | A | | 7/1999 | Wehrli, III et al. | |

* cited by examiner

*Primary Examiner*—Elvin Enad
*Assistant Examiner*—Lisa N Klaus
(74) *Attorney, Agent, or Firm*—Scott A. Rossi

(57) ABSTRACT

An interlock for electric power switches includes indicator followers each following a state indicator on an associated electric power switch indicating the open/closed state of the switch. A first coupler couples one end of an associated elongated connecting member to each indicator follower. A second coupler couples the other end of each elongated connecting member to an auxiliary trip member actuator which actuates an auxiliary trip member on another electric power switch to maintain it in the open/tripped condition when the associated electric power switch is in the closed condition. The first couplers include a swivel through which the elongated connecting member slides and a compliant member, preferably in the form of a helical compression spring, captured between the swivel and a stop nut on the one end of the elongated connecting member.

9 Claims, 7 Drawing Sheets

MECHANICAL INTERLOCK WITH OVERTRAVEL COMPENSATION FOR COORDINATING OPERATION OF CIRCUIT BREAKERS

BACKGROUND OF THE INVENTION

1. Field of the Invention

This invention relates to mechanisms for coordinating the operation of circuit breakers so that only one of the circuit breakers can be closed at any given time. In particular, it relates to an interlock for circuit breakers each having a state indicator indicating the open/closed state of the main contacts of the breaker, and an auxiliary trip member which allows the circuit breaker to be tripped and held open. More particularly, it relates to such an interlock which incorporates a compliant member which allows overtravel of the components coupled to the state indicators without binding of the auxiliary trip members.

2. Background Information

There are a number of applications where the operation of a pair of electrical switches be coordinated such that only one of the switches can be in the on position at a time. One such application is the transfer switch which is used to provide power to a load from two alternative sources. For instance, in many cases, an auxiliary power source is provided as an alternative to a utility source. As these two sources are independent, it is imperative that the one source be disconnected from the load before the other source is connected to prevent interconnection of two sources with a random phase relationship. Typically, circuit breakers are used as the switches in transfer switches so that overload protection is also provided. However, electrical switches without overcurrent protection are also used in transfer switches.

Another situation in which the operation of electrical switches must be coordinated is in ac motor control circuits such as reversing controls where one switch is used to connect the motor to a source with one phase rotation for forward operation and another switch connects the motor with the opposite phase rotation for reverse operation. As in the case of the transfer switches, the switches for the motor control may or may not have overcurrent protection.

It is known to coordinate the operation of two such electrical switches by the use of mechanical interlocks. One type of interlock couples the handles of the two switches. Another type of interlock used particularly when the switches are circuit breakers, utilizes a plunger mounted in the switch housing of each switch which when actuated engages the switch operating mechanism to prevent the switch from closing. In one such interlock, the plungers are coupled to opposite ends of a walking beam so that when one switch is closed it pushes down on its plunger thereby pivoting the walking beam and raising the other plunger to block closing of the other switch. The circuit breaker which is held open lacks sufficient force to override the interlock and force the closed switch open. A related type of interlock described in U.S. Pat. No. 5,436,415, utilizes a pair of pivoted cam plates each coupled to the plunger of one of the circuit breakers and joined by a connecting rod for opposed action. With one of the switches closed, the cam plate associated with the other switch is rotated to an overtoggle position so that a force generated on the plunger of that open switch is directed through the pivot axis of the associated cam plate and therefore applies no force through the connector which would attempt to override the plunger on the closed switch.

Still another type of interlock for a pair of electrical switches is described in U.S. Pat. No. 4,286,242. In this interlock, a plunger actuated by the closing of the contact arm on one switch rotates a connecting rod which acts through another plunger to hold the latch lever of the trip mechanism in the other circuit breaker in the unlatched or tripped position so that the second circuit breaker cannot be closed. A similar arrangement engaging the contact arm of the second breaker rotates a second connecting rod which in turn holds the latch on the first circuit breaker in the unlatched or tripped position when the second breaker is closed.

In a variation of the latter type of interlock, a pivoted arm which follows the rotational position of the pole shaft on one power circuit breaker acts through a connecting rod to rotate another pivoted arm on the other end of the rod to actuate a trip lever on a second power circuit breaker. A similar mechanism holds the first power circuit breaker in the tripped condition when the second is in the closed condition. The connections between the rods and the pivot arms engaging the trip levers on the respective breakers allow these pivot arms to be rotated during alternative actuations of the trip lever without moving the associated rod. To this end, the rods extend through a swivel which slides relative to the rod during reverse rotation of the pivot arm. This mechanism, however, does not allow for overtravel of components.

While all of these interlock mechanisms prevent simultaneous closing of the two switches, the latter two types especially do not accommodate well to variations in tolerances or wear or for overtravel of components.

There is a need therefore for an improved interlock for coordinating the operation of a pair of electrical switches.

There is a particular need for such an improved interlock which can accommodate for variations in tolerances and wear.

There is an additional need for such an improved interlock which will accommodate overtravel of some of the components to assure reliable operation.

SUMMARY OF THE INVENTION

These needs and others are satisfied by the invention which is directed to an interlock for coordinating the operation of electric power switches, and particularly to such electric power switches which have a state indicator indicating the open and closed state of the switch, and an auxiliary trip member which can be moved from an unactuated to an actuated position to hold the associated switch in the open condition. The novel interlock includes indicator followers each following an associated state indicator on an associated electric power switch, and auxiliary trip member actuators each positioned adjacent an associated auxiliary trip member on an associated electric power switch. The interlock further includes elongated connecting members, first couplers each coupling one end of an associated elongated connecting member to an associated indicator follower on a respective one of the electric power switches, and second couplers each coupling the other end of the associated elongated connecting member to an associated auxiliary trip member actuator on the respective other electric power switch to actuate the auxiliary trip member on the other electric power switch to the actuated position when the state indicator on the respective one electric power switch moves to the closed position. Each of the first couplers comprises a compliant member allowing initial movement of the associated state indicator on the one electric power switch before movement of the associated elongated connecting member and allowing overtravel of the state indicator when the associated auxiliary trip member actuator reaches its limit of travel. In the preferred form of the invention, the compliant member is a helical compression spring.

Preferably, each of the indicator followers includes a follower member biased by a biasing spring against the associated state indicator and the first coupler comprises a slip coupling mounted on the follower member with one end of the elongated connecting member slideably extending through this slip coupling. In this arrangement the helical compression spring is captured between the slip coupling and the associated end of the elongated connecting member. In the most preferred arrangement, the state indicator pivots on the associated electric power switch and the follower member is also pivoted. In this arrangement the slip coupling comprises a swivel mounted on the follower member with the elongated connecting member sliding through the swivel. An adjustment mechanism permits adjustment of both the length of the connecting member and the preload on the helical compression spring.

Preferably, the second couplers comprise one way connectors which transmit motion of the elongated connecting member to the associated auxiliary trip member actuator but do not transmit movement of the auxiliary trip movement actuator to the elongated connecting member so that where the auxiliary trip member on the switch can be actuated by an alternate arrangement, this action is not transmitted back through the interlock.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
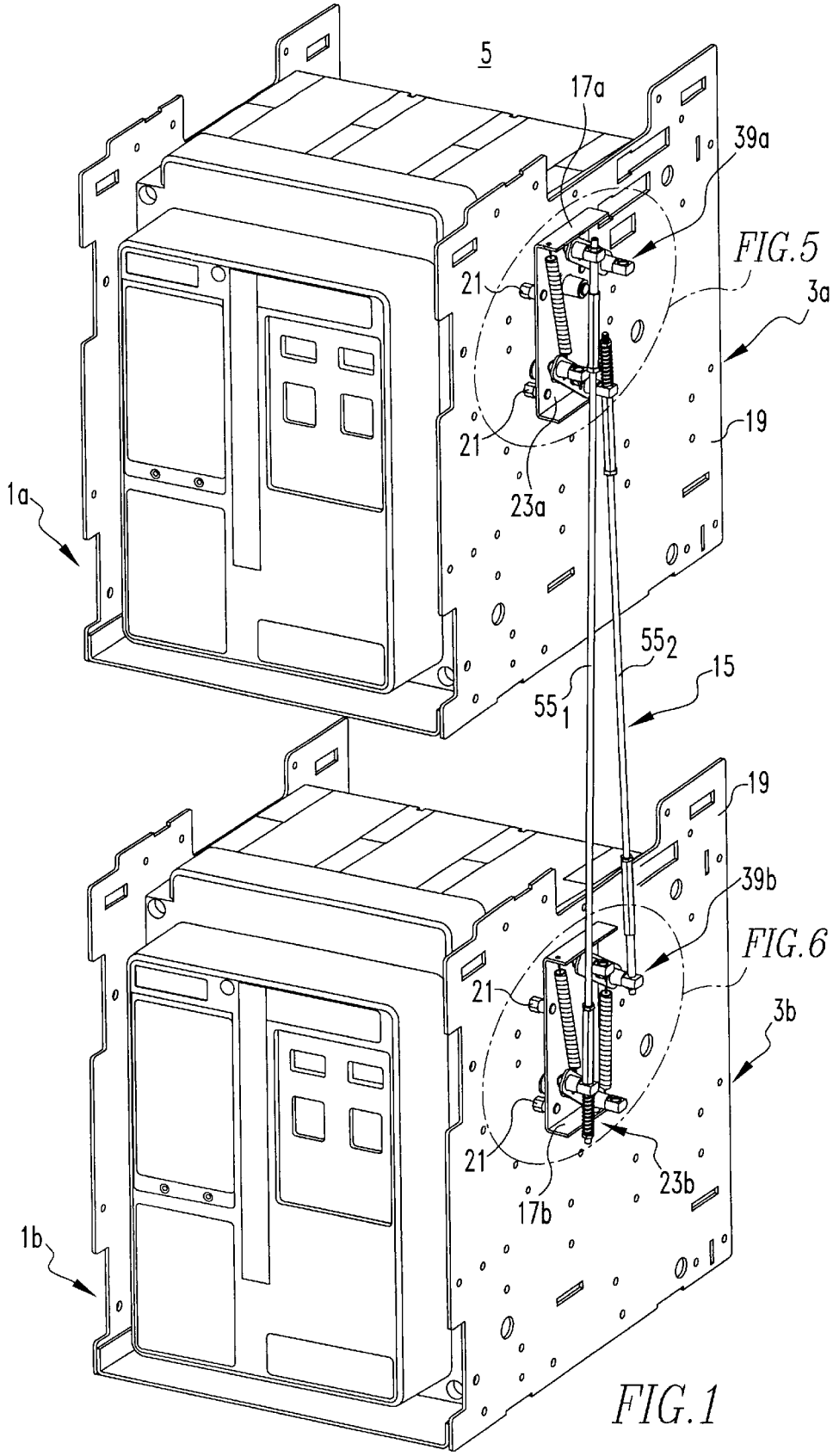
FIG. 1 is an isometric view of two circuit breakers equipped with the interlock of the invention.

The invention will be described as applied to a pair of power circuit breakers, however, it has application to the coordination of the operation of other types of power switches with or without overcurrent protection.

Throughout this description, like parts are identified by like reference characters. Many of the components are common to the two circuit breakers or to the ends of the interlock coupled to the respective circuit breakers. Where it helps to identify the circuit breaker with which a component is associated, the reference character is followed by the suffix "a" or "b". The identical elongated connecting members and couplings which interconnect opposing components on the two ends of the interlock and therefore, interconnect the two circuit breakers are distinguished by the suffixes "1" and "2".

Figure 2:
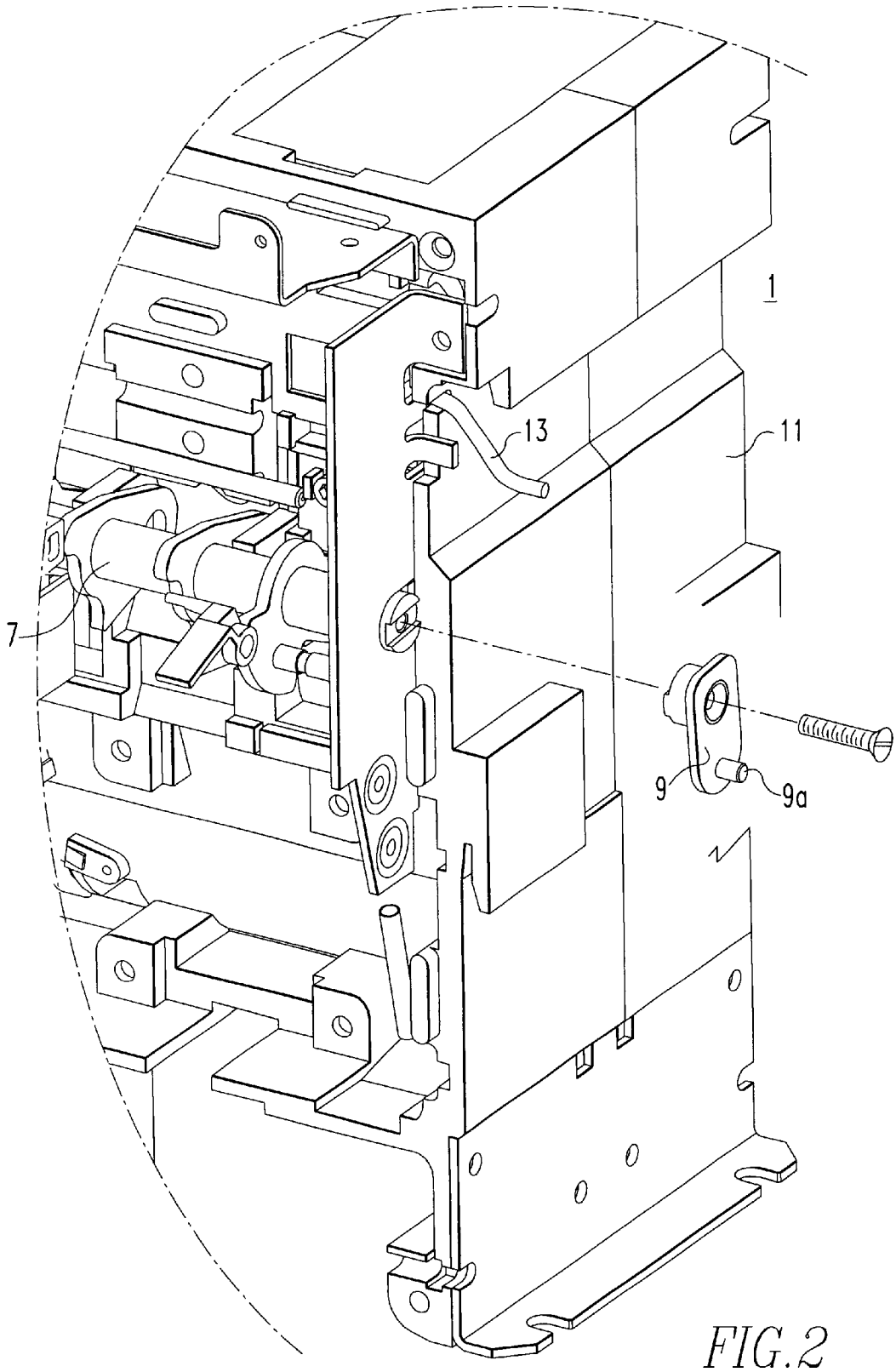
FIG. 2 is a fragmentary exploded isometric view of a portion of one of the circuit breakers of FIG. 1 with the cover removed.

Referring to FIG. 1, a pair of power circuit breakers 1*a* and 1*b* are mounted in vertical alignment in cassettes 3*a*, 3*b* of a switchgear assembly 5. These circuit breakers 1*a* and 1*b*, which can be of the type described in U.S. Pat. No. 5,929,405, have an operating mechanism which includes a pole shaft (see FIG. 2). The pole shaft 7 rotates during opening and closing of the circuit breaker so that a drive arm 9 mounted on the end of the pole shaft outside the casing 11 of the respective circuit breaker serves as a state indicator to indicate the open and/or closed state of the circuit breaker. Each of the circuit breakers 1*a* and 1*b* also has an auxiliary trip member 13 extending outward from the casing 11 above the drive arm 9. This auxiliary trip member can be rotated between an unactuated position and an actuated position in which it holds the circuit breaker in the tripped or open condition.

Figure 3:
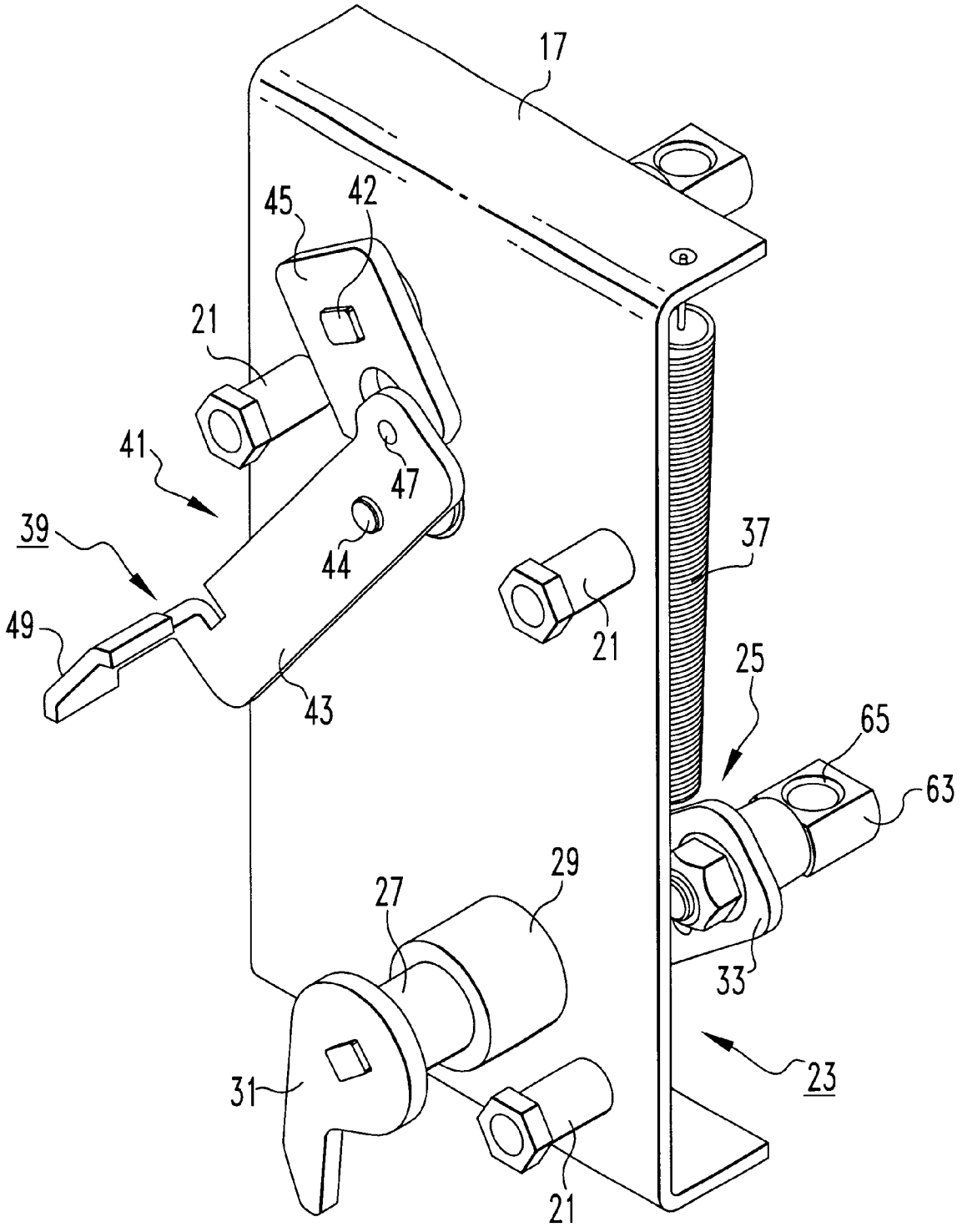
FIG. 3 is a front isometric view of one end of the interlock of the invention.
Figure 4:
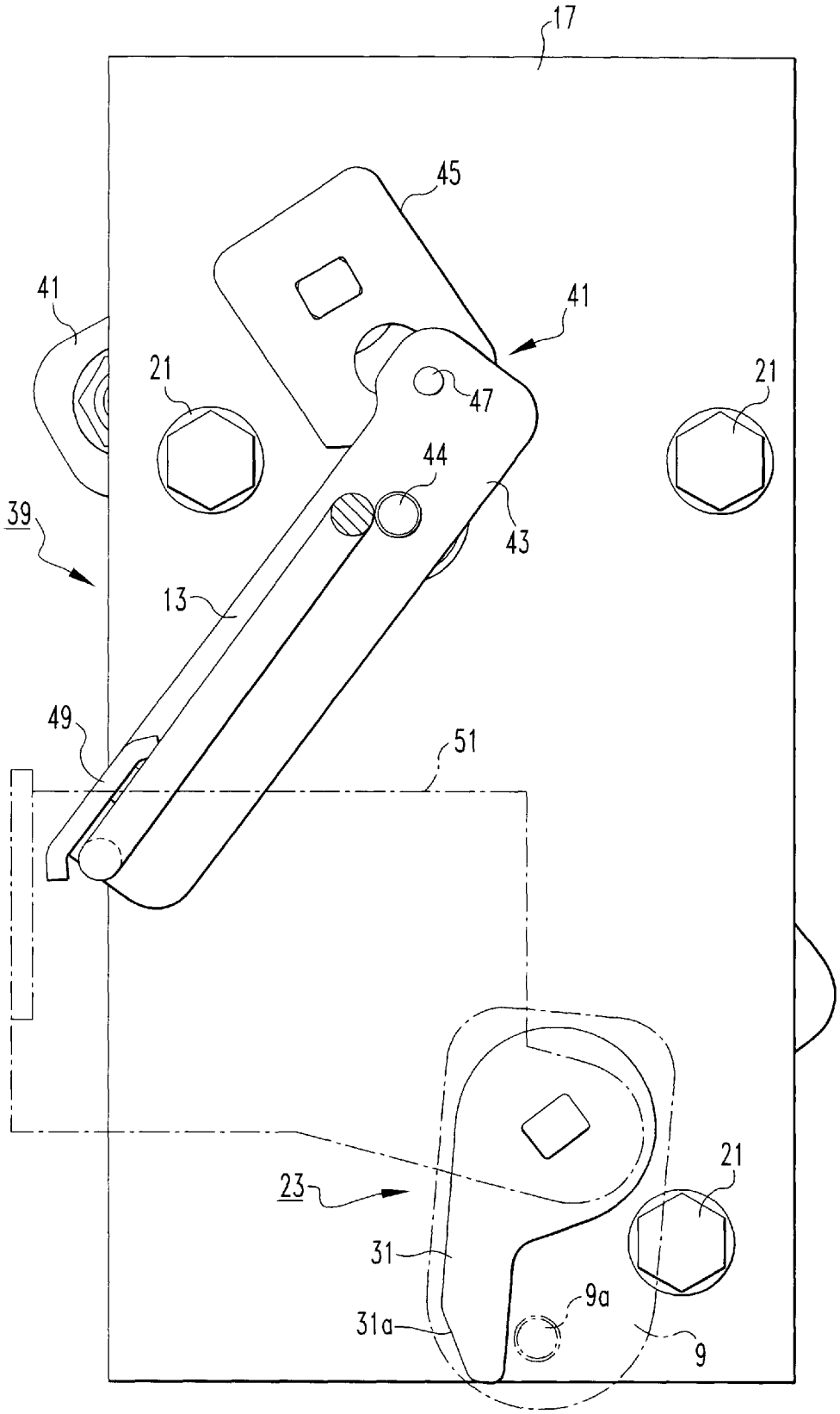
FIG. 4 is a front elevation view of the end of the interlock of FIG. 3 showing coupling of the interlock with a circuit breaker and also showing in phantom the relationship between the one end of the interlock and its interface with a cutout in a cassette in which the associated circuit breaker is mounted.
Figure 7:
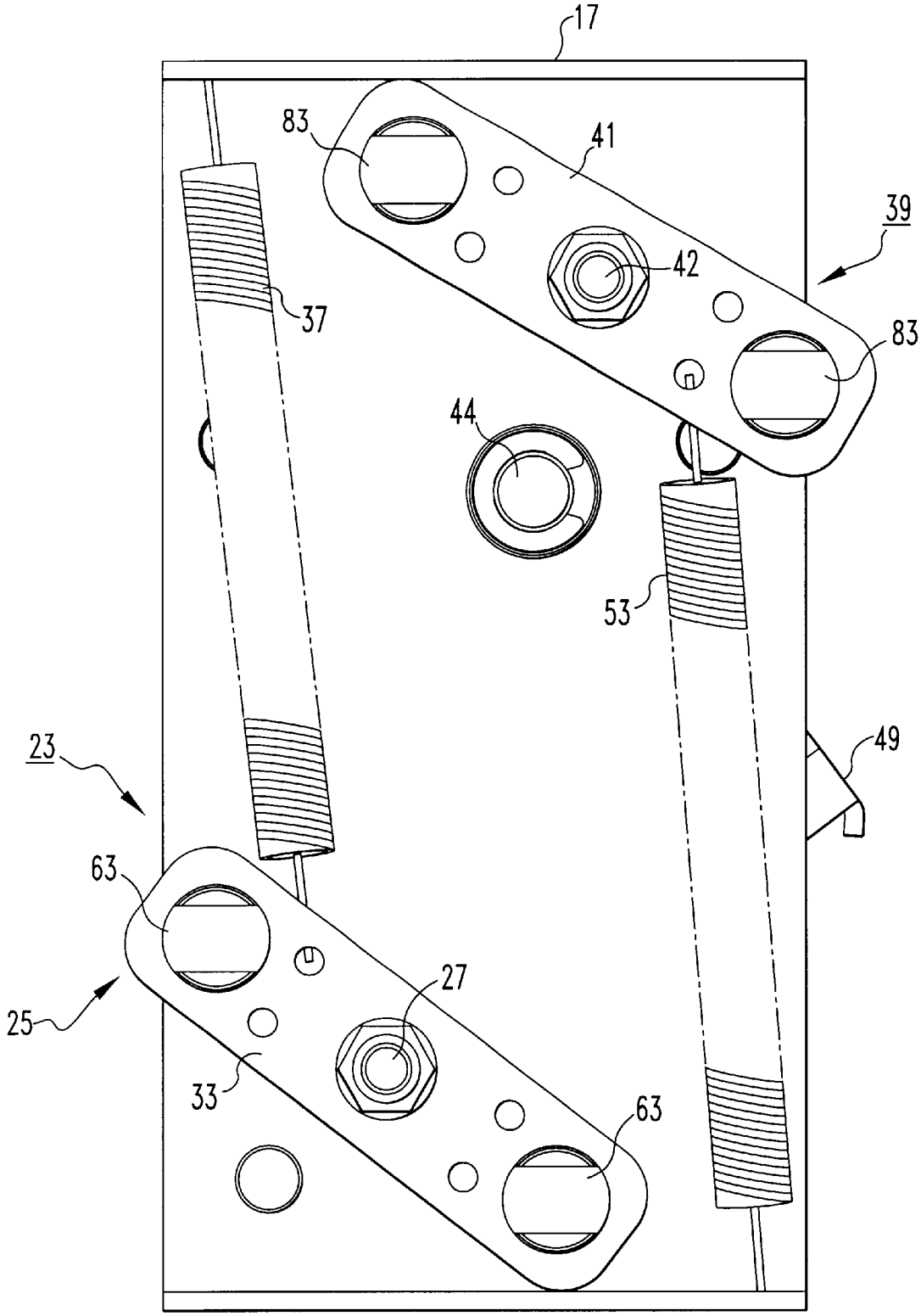
FIG. 7 is a rear elevation view of the interlock of FIG. 3.

In order to coordinate the operation of the two circuit breakers 1*a*, 1*b*, so that only one may be in the closed condition at any one time, an interlock 15 couples the state indicator on each circuit breaker with the auxiliary trip member on the other circuit breaker. The interlock 15 includes a pair of brackets, 17*a* and 17*b*, secured to the outer surface of the side wall 19 of the cassettes 3*a*, 3*b*, associated with each of the circuit breakers by standoffs 21. Pivotally mounted on each bracket 17*a*, 17*b* is an indicator follower 23*a*, 23*b*. As best seen in FIGS. 3, 4 and 7, each indicator follower 23*a* + 23*b* includes a follower shaft 27 rotatably mounted in the bracket by a bearing 29.

The follower shaft 27 extends through the cassette wall 19 and supports a follower finger 31 adjacent the associated state indicator. A follower arm 33 is secured to the outer end of the respective follower shaft 27. A biasing spring in the form of helical tension spring 37 biases the follower member 25 in the counterclockwise direction as viewed in FIG. 3 (clockwise in FIG. 7).

Returning to FIG. 1, the interlock 15 also includes a pair of auxiliary trip member actuators 39*a*, 39*b*. Again, as shown in FIGS. 3, 4 and 7, these auxiliary trip member actuators 39 each comprise an actuator member which includes a first actuator member 41 pivotally mounted on the outside of the associated bracket 17 on pivot shaft 42 and a second actuator member 43 pivotally mounted on the opposite side of the bracket 17 on shaft 44. A reversing cam 45 mounted for rotation with the first actuator member 41 on shaft 42 has a drive pin 47 which engages the second actuator member 43 so that rotation of the first actuator member in one direction results in rotation of the second actuator member in the opposite direction. The second actuator member 43 has a lateral projection or paddle 49 which extends through an opening 51 (see FIG. 4) in the cassette sidewall 19 and is positioned adjacent the auxiliary trip member 13 on the associated circuit breaker 1*a* or 1*b*. The auxiliary trip member actuator 39 includes a second biasing spring in the form of helical tension spring 53 connected to the first actuator member 41 which biases the projection 49 on the second actuator member 43 clockwise as viewed in FIGS. 3 and 4 against the upper edge of the opening 51 and away from the auxiliary trip member 13.

Figure 5:
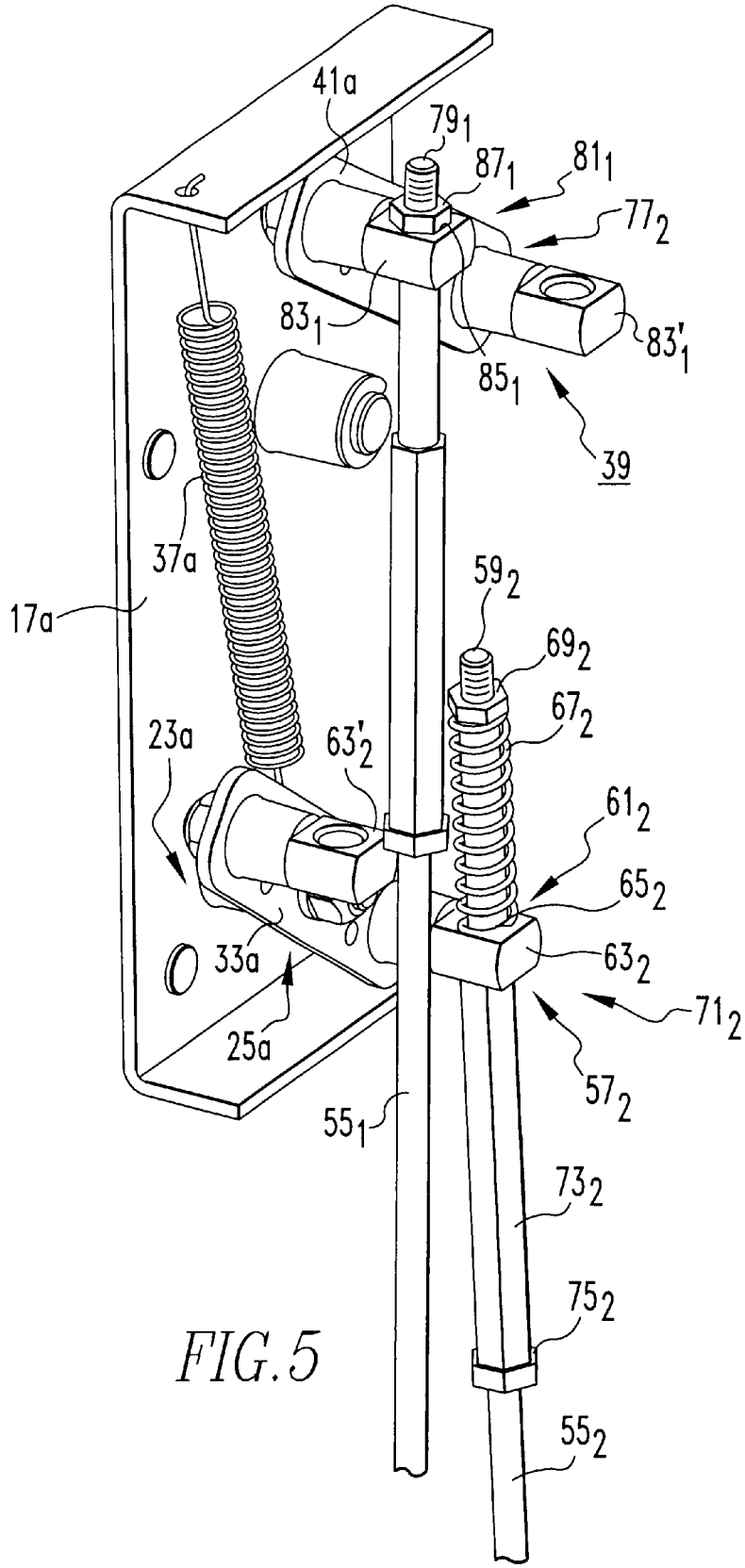
FIG. 5 is a fragmentary isometric view in enlarged scale of the upper end of the interlock as shown in FIG. 1.
Figure 6:
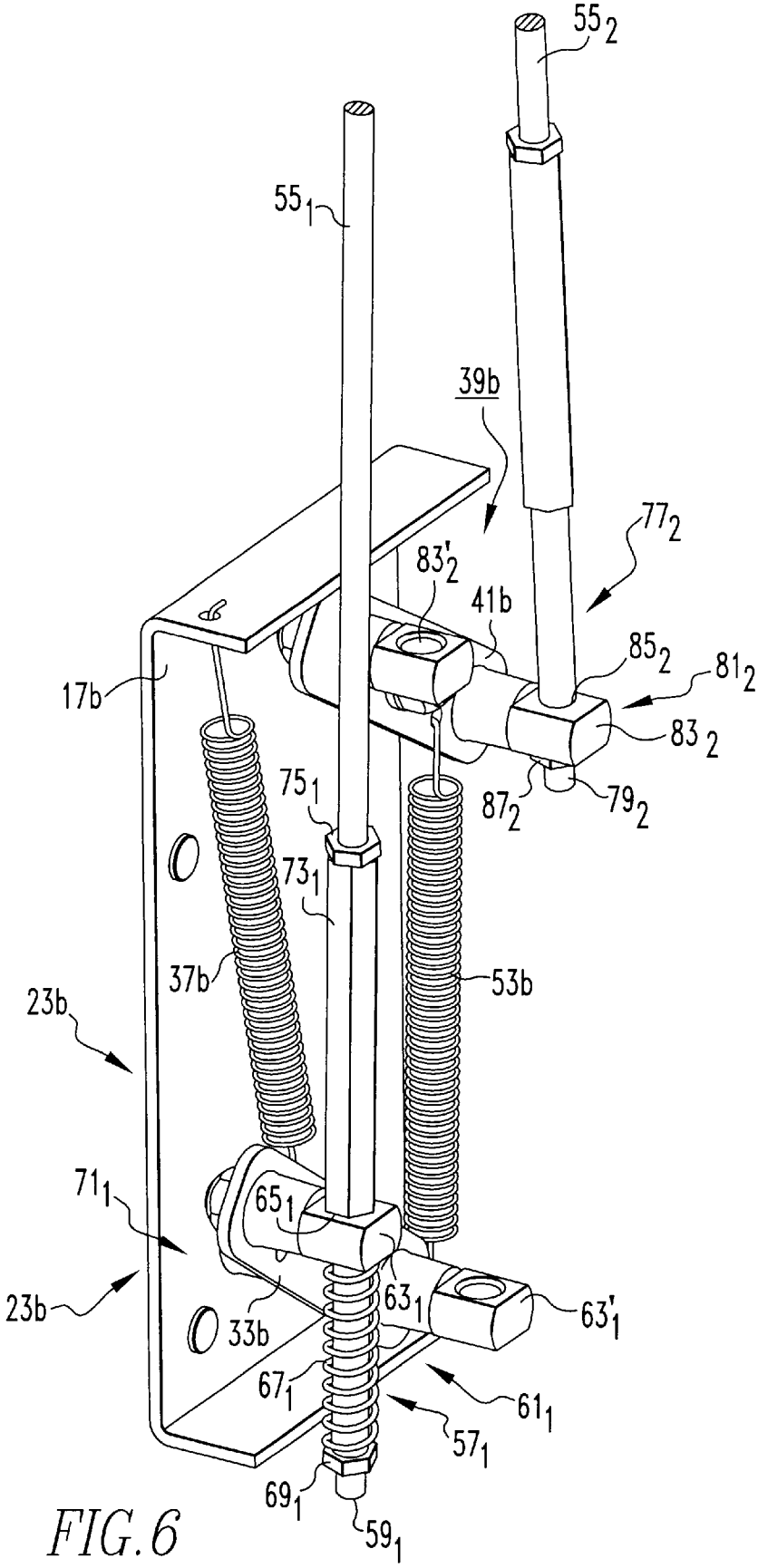
FIG. 6 is a fragmentary isometric view in enlarged scale of the lower end of the interlock as shown in FIG. 1.

As seen in FIGS. 1, 5 and 6, the interlock 15 also includes a pair of elongated connecting members 55. A pair of first couplers $57_1$, $57_2$ connect one end 59, $59_2$ of each of the elongated connecting members to an associated indicator follower 23*b*, 23*a* on a respective one of the circuit breakers 1*b*, 1*a*. These first couplers 57 include a slip connection $61_1$, $61_2$ formed by a swivel 63*a*, 63*b* pivotally mounted on an end of the associated follower arm 33*a*, 33*b* and having a through aperture 65*a*, 65*b* through which the one end $59_1$, $59_2$ of the elongated connecting member slides. These first couplers further include a compliant member in the form of a helical compression spring $67_1$, $67_2$.

The helical compression spring $67_1$, $67_2$ is captured between the associated swivel $63_1$, $63_2$ and a stop formed by an adjusting nut $69_1$, $69_2$ threaded onto the end $59_1$, $59_2$ of the elongated connecting member $55_1$, $55_2$. This nut $69_1$, $69_2$ forms part of an adjustment mechanism $71_1$, $71_2$ included in each of the first couplers 57*a*, 57*b* . Threading of the nut $69_1$, $69_2$ along the one e connecting member $55_1$, $55_2$ adjusts the preload on the helical compression spring $67_1$, $67_2$. The adjusting mechanism 71 also includes another threaded member $73_1$, $73_2$ engaging threads on the elongated connecting member and bearing against the opposite side of the swivel $63_1$, $63_2$ from the helical compression spring $67_1$, $67_2$. Adjustment of this threaded member $73_1$, $73_2$ along the elongated connecting member $55_1$, $55_2$ adjusts the effective length of the elongated connecting member 55. A lock nut $75_1$. $75_2$ can be provided to fix the position of the threaded member $73_1$, $73_2$. The interlock 15 also includes a pair of second couplers $77_1$, $77_2$ which connect the other ends $79_1$, $79_2$ of the elongated connecting members $55_1$, $55_2$ to the associated auxiliary trip member actuator 39*a*, 39*b*. Each second coupler $77_1$, $77_2$ comprises a one way connector $81_1$, $81_2$ which transmits motion from the associated elongated connecting member $55_1$, $55_1$, to the auxiliary trip member actuator 39*a*, 39*b*, but does not transmit movement of the auxiliary trip member actuator 39*a*, 39*b* back to the elongated connecting member $55_1$, $55_2$. Each one way connector $81_1$, $81_2$ includes additional swivels $83_1$, $83_2$ pivotally mounted to the associated first actuator member 41*a*, 41*b* and having through holes $85_1$, $85_2$, though which the opposite ends $79_1$, $79_2$ of the elongated connecting members extend. Stops in the form of nuts $87_1$, $87_2$ are provided on the ends $79_1$, $79_2$ of the elongated connecting members. These stops are larger than the holes $85_1$, $85_2$.

In the exemplary embodiment of the invention, the elongated connecting members $55_1$, $55_1$, are tension members. While cables could be used for these tension members, the exemplary tension members are threaded rods. Where the two circuit breakers are mounted side-by-side rather than being vertically aligned, cables would be used for the tension members.

With both circuit breakers 1*a*, 1*b* in the open position, the respective drive arms 9, are in the vertical position shown in FIG. 4. The biasing springs 37 bias the associated follower fingers 31 against the associated drive pin 9. Under these conditions, the biasing springs 53 bias the projections 49 of the auxiliary trip member actuators 39 away from the associated auxiliary trip member 13. When one of the circuit breakers is closed, the associated pole shaft rotates to rotate the drive arm in a counterclockwise rotation as viewed in FIG. 2. Assuming for purposes of illustration, that the circuit breaker 1*a* is closed, the drive arm 9*a* engages the follower finger 31*a* rotating it clockwise as viewed in FIG. 3. This results in rotation of the arm 33*a* of the associated follower member 25*a* in the counterclockwise direction, as viewed in FIG. 5. Thus, the swivel $63_2$ lifts up on the helical compression spring $67_2$ compressing it during initial rotation of the follower member. The force generated is then applied through the spring $67_2$ to the connecting rod $55_1$, to raise the rod upward. Upward movement of the connecting rod $55_1$, results in counterclockwise rotation of the first actuator member 41*b* of the auxiliary trip member actuator 39*b*. This rotation is reversed by the reversing cam 45 so that the second actuator member 47 is rotated counterclockwise as viewed in FIG. 3. With this motion, the projection 49 on the second actuator member 43 engages the auxiliary trip member 13 on the circuit breaker 1*b* to rotate it counterclockwise as viewed in FIG. 2 and thereby hold the circuit breaker 1*b* in the tripped condition so that it cannot be closed. As discussed, 3*b* the projection 49 extends through the opening 51 in the sidewall 19 of the cassette 3*b* in which the circuit breaker 1*b* is mounted. When the projection 49*b* comes to rest against the edge of this opening 51, the follower member 25*a* permits overtravel of the drive arm 9 on the circuit breaker 1*a* through compression of the spring $67_2$.

In a similar manner, when the circuit breaker 1*b* is closed, the follower member 25*b* is rotated counterclockwise as viewed in FIGS. 1 and 6. This results in initial compression of the spring $67_1$, followed by lowering of the connecting rod $55_1$, to rotate the auxiliary trip member actuator 39*a* counterclockwise (see FIG. 5). As this occurs, the paddle 49 engages and rotates the auxiliary trip member 13 counterclockwise as viewed in FIG. 2 to hold the circuit breaker 1*a* in the tripped condition.

Although not shown, each of the circuit breakers 1*a*, 1*b* is tripped by a device as the circuit breaker is withdrawn from the cassette. The mechanism (not shown) which provides this function also rotates the auxiliary trip member actuators 39*a*, 39*b*. The one way connectors $81_1$, $81_2$ formed by the swivels $83_1$, $83_2$ allow this motion to occur without applying force to the connecting rods $59_1$, $592_1$.

In an alternate configuration, the elongated connecting members $55_1$, $55_2$ can be compression members (not shown) rather than tension members. In such an arrangement, additional swivels, $63_1'$, $63_2'$, are provided on the opposite end of the pivoted follower arms 33*a*, 33*b* so that when the associated circuit breaker closes, the follower arm 33*a*, 33*b* pushes on the associated elongated connecting member. The rods then push against additional swivels $83_1'$, $83_2'$ provided on the opposite ends of the first actuator members 41*a*, 41*b* to actuate the associated auxiliary trip member 13.

The interlock 15 does not draw significant energy from the closing circuit breaker. In addition, incorporation of the compliant member in the form of the helical compression springs $67_1$, $67_2$ minimizes shock loading on the interlock drive rods or cables. This eliminates faulty operation and or jamming of the interlock. The interlock of the invention also provides for overtravel of the drive arm on the circuit breakers to compensate for tolerance errors, variation in customer mounting locations, wear and slight misalignment. It also decouples alternate actuation of the auxiliary trip member on one circuit breaker from the other circuit breaker.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An interlock for coordinating operation of electric power switches each having a switch state indicator movable between a switch open position and a switch closed position and an auxiliary trip member movable between an unactuated and an actuated position, said interlock comprising:

indicator followers each following an associated state indicator on an associated electric power switch;

auxiliary trip member actuators each positioned adjacent an associated auxiliary tip member on an associated electric power switch;

elongated connecting members;

first couplers each coupling one end of an associated elongated connecting member to an associated indicator follower on a respective one of said electric power switches; and second couplers each coupling the other end of an associated elongated connecting member to an associated auxiliary trip member actuator on a respective other electric power switch to actuate said auxiliary trip member on the respective other electric power switch to said actuated position when said state indicator on the respective one electric power switch movers to said closed position;

said first couplers each comprising a compliant member allowing initial movement of the associated state indicator on the respective one electric power switch before movement of the associated elongated connecting member and overtravel of the state indicator, wherein said Indicator followers each comprise a follower member and a biasing spring biasing said follower member against said state indicator.

2. The interlock of claim 1 wherein said first couplers each comprise a first slip coupling mounted on the associated follower member, said one end of the associated elongated connecting member slideably extending through said first slip coupling and said compliant member comprising a helical compression spring captured between said first slip coupling and said one end of said associated elongated connecting member.

3. The interlock of claim 2 wherein each said second coupler comprises a one way connector transmitting motion of the associated elongated connecting member to the associated auxiliary trip member actuator but not transmitting movement of said auxiliary trip member actuator to said elongated connecting member.

4. The interlock of claim 2 wherein each of said state indicators pivots on the associated electric power switch, and wherein said indicator followers each includes a pivotal mount for each follower member and said first slip coupling comprises a swivel pivotally mounted on the associated follower member, said elongated connecting member sliding through said swivel.

5. The interlock of claim 4 wherein said first couplers each further comprise a first adjusting mechanism adjusting at least one of preload on said helical compression spring and length of said associated elongated connecting member between the associated follower member and the associated auxiliary trip member actuator.

6. The interlock of claim 5 wherein each said elongated connecting member comprises a rod threaded at said one end and said adjusting mechanism comprises a nut threaded on said one end of said rod to adjust preload on said helical compression spring.

7. The interlock of claim 5 wherein each said elongated connecting member comprises a tension member.

8. The interlock of claim 5 wherein each elongated connecting member comprises a rod threaded adjacent said swivel, and said first adjusting mechanism comprises a threaded member threaded on said rod and bearing against said swivel opposite said helical compression spring for adjusting length of said rod.

9. The interlock of claim 8 wherein each said rod is threaded adjacent said one end and said first adjustment mechanism further comprises a nut on said one end of said rod for adjusting preload on said helical compression spring.

* * * * *